US011629918B2

(12) United States Patent
Cardon et al.

(10) Patent No.: US 11,629,918 B2
(45) Date of Patent: Apr. 18, 2023

(54) HEAT EXCHANGER WITH IMPROVED WAVE JUNCTION, ASSOCIATED INSTALLATION OF AIR SEPARATION AND METHOD FOR MANUFACTURING SUCH AN EXCHANGER

(71) Applicant: L'Air Liquide, Societe Anonyme pour l'Etude et l'Exploitation des Procedes Georges Claude, Paris (FR)

(72) Inventors: Guillaume Cardon, Poissy (FR); Frederic Crayssac, Velizy (FR); Philippe Grigoletto, Villeparisis (FR); Natacha Haik-Beraud, Champigny-sur-Marne (FR); Frederic Rousseau, Fontenay le Fleury (FR); Marc Wagner, Saint Maur des Fosses (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 544 days.

(21) Appl. No.: 16/607,160

(22) PCT Filed: Apr. 12, 2018

(86) PCT No.: PCT/FR2018/050924
§ 371 (c)(1),
(2) Date: Oct. 22, 2019

(87) PCT Pub. No.: WO2018/197776
PCT Pub. Date: Nov. 1, 2018

(65) Prior Publication Data

US 2020/0386486 A1 Dec. 10, 2020

(30) Foreign Application Priority Data

Apr. 27, 2017 (FR) ..... 1753704

(51) Int. Cl.
*F28D 9/00* (2006.01)
*F25J 5/00* (2006.01)
(Continued)

(52) U.S. Cl.
CPC ..... *F28D 9/0068* (2013.01); *F25J 5/005* (2013.01); *F28F 9/026* (2013.01); *F25J 2250/04* (2013.01); *F28D 2021/0033* (2013.01)

(58) Field of Classification Search
CPC . F28D 9/0068; F28D 2021/0033; F25J 5/005; F25J 2250/04; F28F 9/026
(Continued)

(56) References Cited

U.S. PATENT DOCUMENTS 2,595,308 A * 5/1952 Simpelaar ..... F28D 9/0062 165/165
3,256,704 A * 6/1966 Becker ..... F25J 3/04884 62/903
(Continued)

FOREIGN PATENT DOCUMENTS

FR 2 547 898 12/1984
FR 2 938 904 5/2010
(Continued)

OTHER PUBLICATIONS

International Search Report and Written Report for PCT/FR2018/050924, dated Jul. 4, 2018.
(Continued)

*Primary Examiner* — Tho V Duong
*Assistant Examiner* — Raheena R Malik
(74) *Attorney, Agent, or Firm* — Justin K. Murray

(57) ABSTRACT

The invention relates to a heat exchanger for vaporizing a coolant fluid by heat exchange with a calorigenic fluid, said exchanger comprising several parallel plates defining a plurality of passages between them which are suitable for
(Continued)

the coolant fluid or calorigenic fluid to flow, a first wave and a second wave extending between two successive plates so as to define a plurality of channels within the same passage, said first and second waves comprising two adjacent edges, at least one assembly member extending from one edge to the other so as to connect the waves to one another. According to the invention, the assembly member is forcibly engaged in at least one part of a channel of the first wave on one hand, and in at least one part of a channel of the second wave on the other hand.

15 Claims, 4 Drawing Sheets

(51) Int. Cl.
*F28F 9/02* (2006.01)
*F28D 21/00* (2006.01)

(58) Field of Classification Search
USPC ..... 165/165
See application file for complete search history.

(56) References Cited

U.S. PATENT DOCUMENTS

| | | | | |
|---|---|---|---|---|
| 6,338,384 | B1 * | 1/2002 | Sakaue | F28D 9/0068 62/903 |
| 8,985,192 | B2 * | 3/2015 | Mitsuhashi | F28D 9/0093 165/165 |
| 9,086,244 | B2 * | 7/2015 | Crayssac | F25J 5/005 |
| 2011/0220482 | A1 * | 9/2011 | Crayssac | F28F 3/025 165/104.21 |
| 2020/0386486 | A1 * | 12/2020 | Cardon | F25J 5/005 |

FOREIGN PATENT DOCUMENTS

| | | |
|---|---|---|
| JP | 07159074 | 6/1995 |
| JP | 2012 516 425 | 7/2012 |

OTHER PUBLICATIONS

French Search Report and Written Opinion for FR 1753704, dated Jan. 11, 2018.

* cited by examiner

HEAT EXCHANGER WITH IMPROVED WAVE JUNCTION, ASSOCIATED INSTALLATION OF AIR SEPARATION AND METHOD FOR MANUFACTURING SUCH AN EXCHANGER

CROSS REFERENCE TO RELATED APPLICATIONS

This application is a § 371 of International PCT Application PCT/FR2018/050924, filed Apr. 12, 2018, which claims the benefit of FR1753704, filed Apr. 27, 2017, both of which are herein incorporated by reference in their entireties.

TECHNICAL FIELD OF THE INVENTION

The present invention relates to a heat exchanger of the brazed plate and fin type for vaporizing a liquid refrigerant through exchange of heat with a thermogenic fluid, and to a method for assembling such an exchanger.

The heat exchanger may in particular be a vaporizer used in an air separation column separating air by cryogenic distillation in order to vaporize a column bottom liquid, for example liquid oxygen, by exchange of heat with a thermogenic gas, for example air or nitrogen.

BACKGROUND OF THE INVENTION

The present invention notably finds application in the field of the cryogenic separation of gases, particularly the cryogenic separation of air, in what is known as an ASU (air separation unit) used to produce pressurized gaseous oxygen. In particular, the present invention may be applied to a heat exchanger which vaporizes a flow of liquid, for example oxygen, nitrogen and/or argon by exchange of heat with a gas.

If the heat exchanger is in the bottom of a distillation column, it may constitute a vaporizer operating as a thermosiphon for which the heat exchanger is immersed in a bath of liquid running down the column or a vaporizer performing film vaporization fed directly with the liquid falling from the column and/or by a circulation pump.

The technology commonly employed for such phase-change exchangers is that of aluminum brazed plate and fin exchangers, which make it possible to obtain components that are highly compact and offer a large exchange surface area. These exchangers are made up of plates between which corrugated plates or fins are inserted, thus forming a stack of vaporization "passages" and of condensation "passages". There are various types of corrugated fin, such as plain, perforated or partially offset (serrated) fin corrugated fins.

In the case of vaporizers operating in falling-film mode, part of the device is devoted to distributing the liquid in the vaporization passages and between the channels of the heat exchange corrugated fin.

This distribution, which is specific to each vaporizer is conventionally achieved in accordance with the principle described in FR-A-2547898: the vaporization passages are fed from the top of the condensation passages. The oxygen then passes through a row of holes which perform its primary distribution into the vaporization passages. It then flows through a strip of corrugated fins of horizontal generatrix which performs a finer distribution, referred to as secondary distribution, aimed at distributing the liquid oxygen between the channels arranged in the vaporization passages downstream of the strip of corrugated fins of horizontal generatrix.

The liquid oxygen, which is vaporized contains impurities in dissolved form. The main impurities are nitrous oxide ($N_2O$), carbon dioxide ($CO_2$), and hydrocarbons ($C_2$, $C_3$, . . . ). Depending on the operating conditions, these impurities may be deposited (either in solid form or in liquid form) in the vaporization passages. It is important at an industrial level to keep control of the formation of these solid or liquid deposits in order to avoid any risk of explosion.

One of the parameters that is key to the formation of deposits is the flow rate of liquid per channel (or expressed per meter of perimeter to be wetted). Specifically, when the flow rate of liquid per channel is not enough to wet the wall, deposits are formed by evaporation to dryness.

In this type of (film) vaporizer, the distribution of liquid oxygen plays an essential part in its operation (performance and safety). It is therefore necessary under all circumstances to ensure a good distribution of liquid within each channel. In order to do that, the distribution of liquid between channels needs to be sufficiently uniform. A non-uniform distribution of liquid may lead to poor wetting of the wavy corrugated plates, particularly in the lower part of the exchanger and, therefore, to the formation of deposits by evaporation to dryness. The difficulty is that of ensuring an equivalent flow rate of liquid in all the channels given the number of channels per passage and per body (550 channels/passage, 55 000 channels/body).

The quality of this liquid distribution is dependent on correct design and dimensioning of the distributor.

The so-called secondary distribution (the distribution of the liquid between the channels) typically uses a strip of corrugated fins with a horizontal generatrix, possibly of the partially offset (serrated) fin type.

Now, the arrangement of this strip of corrugated fins inside each vaporization passage exhibits certain disadvantages.

Specifically, because of the width of the passages defined between each plate of the exchanger, which is typically of the order of 1000 to 1200 mm, it is necessary to juxtapose at least two corrugated fins in the one same passage in order to line the entire width thereof.

During the assembly of the exchanger, these corrugated fins are juxtaposed with zero or near-zero clearance. However, the step of attaching the corrugated fins to the adjacent plates by brazing may introduce a clearance (gap) at the junction between two corrugated fins. In particular, a slight shifting of one corrugated fin with respect to the other may occur as the braze metal melts.

The clearances between adjacent corrugated fins constitute preferred passages for the liquid to follow, leading to the channels situated just below the clearance being oversupplied with liquid and, more especially, to the channels around the periphery thereof being undersupplied with liquid.

Document FR-A-2938904 discloses solutions that make it possible to hold the corrugated fins of an exchanger together. However, these solutions are not entirely satisfactory, particularly as they do not allow the corrugated fins to be assembled with one another robustly enough. Furthermore, these solutions may present problems because of the complexity and cost of the retaining components used and the difficulty with fitting them within the exchanger, something which is incompatible with a method for industrial-scale manufacture.

SUMMARY OF THE INVENTION

It is a notable object of certain embodiments of the present invention to solve all or some of the above-mentioned problems by providing a heat exchanger in which the distribution of the refrigerant fluid is as uniform as possible.

To this end, one subject of the invention is a heat exchanger for vaporizing a refrigerant fluid by exchange of heat with a thermogenic fluid, said exchanger comprising:

- several parallel plates between them defining a plurality of passages designed for the flow of the refrigerant fluid or of the thermogenic fluid,
- a first corrugated fin and a second corrugated fin extending between two successive plates in such a way as to define, within the one same passage, a plurality of channels, said first and second corrugated fin comprising two adjacent edges,
- at least one assembly member extending on each side of the edges so as to join said corrugated fins together, characterized in that the assembly member is forcibly engaged, on the one hand, in at least part of a channel of the first corrugated fin and, on the other hand, in at least part of a channel of the second corrugated fin.

As the case may be, the exchanger according to the invention may comprise one or more of the following features:

- several assembly members are arranged along the adjacent edges.
- the channels and the assembly member extend overall parallel to a first direction z.
- the assembly member has, in at least a second direction x orthogonal to the first direction z and prior to engagement, an external dimension that is greater than or equal to, preferably strictly greater than, the internal dimensions of the channels in said second direction x.
- the ratio between the internal dimension of the channel of the first corrugated fin (1) and said external dimension of the assembly member and the ratio between the internal dimension of the channel of the second corrugated fin and said external dimension of the assembly member are comprised between 100 and 70%, preferably comprised between 95 and 85%.
- the ratio between the cross section of the assembly member and the cross section of the channel of the first corrugated fin and/or the ratio between the cross section of the assembly member and the cross section of the channel of the second corrugated fin, said cross sections being measured in a plane perpendicular to the first direction z, is less than or equal to 50%, preferably comprised between 15 and 35%.
- the second direction x extends parallel to the adjacent edges.
- the assembly member is of cylindrical shape and has a given outside diameter, the ratios between the widths of the channels, measured in the second direction x, and said outside diameter being comprised between 100 and 70%, preferably comprised between 95 and 85%.
- the outside diameter of the assembly member is comprised between 0.5 and 2 mm, preferably comprised between 1 and 1.3 mm.
- the assembly member comprises a first portion forcibly engaged in at least part of one channel and a second portion forcibly engaged in at least part of a channel of the second corrugated fin, said first and second portions having lengths, measured parallel to the first direction z, greater than or equal to 5 mm, preferably between 30 and 50 mm, more preferably still, approximately equal to 40 mm.
- the assembly member comprises a holed or slotted peripheral wall.
- the first and second corrugated fins are formed from a first material and the assembly member is formed from a second material, the second material having a melting point higher than or equal to the melting point of the first material.
- the plates extend parallel to a direction x referred to as the flow direction, the channels and the assembly member extend overall in a first direction z orthogonal to the flow direction y.
- the first and second corrugated fins each comprise a succession of corrugation legs connected by corrugation vertices, the assembly member being forcibly engaged, on the one hand, between at least portions of two successive corrugation legs of the first corrugated fin and, on the other hand, between at least portions of two successive corrugation legs of the second corrugated fin.
- each channel is defined between a plate, two successive corrugation legs of the first or of the second corrugated fin and a corrugation vertex connecting said two corrugation legs.
- the first and second corrugated fins are chosen from plain-fin, perforated-fin, serrated, wavy-fin or herringbone-fin corrugations.

Another aspect of the invention relates to an air separation installation separating air by distillation, characterized in that it comprises at least one heat exchanger as claimed in one of the preceding claims, and in that the installation comprises feed means for distributing liquid oxygen by way of refrigerant fluid, and gaseous nitrogen by way of thermogenic fluid, into the passages of the exchanger.

Furthermore, the invention also relates to a method for assembling a heat exchanger according to the invention, characterized in that it comprises the following steps:

- arranging the first corrugated fin and the second corrugated fin between two successive plates,
- juxtaposing two edges of the first and second corrugated fins,
- forcibly engaging the assembly member in, on the one hand, at least part of a channel of the first corrugated fin and, on the other hand, at least part of a channel of the second corrugated fin,
- assembling the first corrugated fin and the second corrugated fin to the plates using brazing.

BRIEF DESCRIPTION OF THE DRAWINGS

The present invention will be clearly understood and its advantages will arise from the description which follows, given merely as a non-limitative example, and with reference to the attached drawings in which.

DETAILED DESCRIPTION

Figure 1:
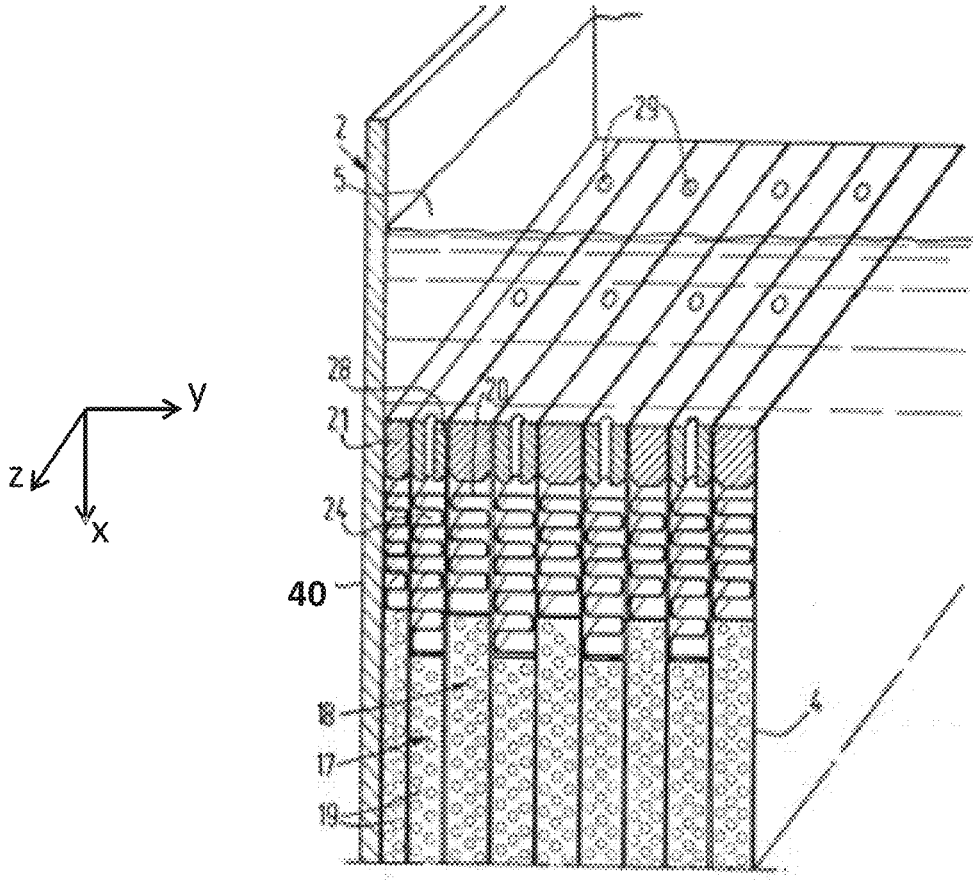
FIG. 1 is a partial three-dimensional view of an exchanger according to one embodiment of the invention.

FIG. 1 illustrates one embodiment of a heat exchanger 2 that can be used in an air distillation installation of the double column type. In operation, an exchange of heat takes place between liquid oxygen by way of refrigerant fluid and gaseous nitrogen by way of thermogenic fluid.

The exchanger 2 comprises a fluidtight shell 40 containing a collection of rectangular plates 4, generally made of aluminum, which extend roughly parallel to one another. The plates 4 thus define a plurality of passages intended for the flow of oxygen (passages 17) or for the flow of nitrogen (passages 18).

Over most of their height, the passages 17, 18 each contain heat exchange corrugated fins 19 made up in this example of sheets of perforated corrugated aluminum. These heat-exchange corrugated fins 19 are preferably of the type having a vertical generatrix, or arranged in the so-called "easyway" configuration. In this case, the heat-exchange corrugated fins 19 have, in operation, an overall direction of corrugation (in the direction z in FIG. 1) perpendicular to the direction of flow (in the direction x in FIG. 1) of the fluids in the passages concerned.

At the upper end of the passages 17 and 18, the heat-exchange corrugated fins 19 are respectively extended by distribution corrugated-fin strips 24 and conventional corrugated fins 20. Above the corrugated fins 20, the passages 17 and 18 are respectively closed off by horizontal bars 28 and 21.

The space situated above the plates 4 encloses a bath of liquid oxygen 5. The liquid oxygen of the bath 5 flows through orifices 29 pierced along the bars 28 to perform a primary distribution of the liquid oxygen between all the passages 17 for the oxygen and across the entire width of each passage 17 in the direction of the strips of corrugated fins 24. The strips of corrugated fins 24 are generally formed of non-perforated sheets of corrugated aluminum of the type having a horizontal generatrix, or arranged in the so-called "hardway" configuration. In this case, the strips of corrugated fins 24 have, in operation, an overall direction of corrugation (in the direction x in FIG. 1) parallel to the direction of flow of the fluids in the passages concerned.

At the same time, the gaseous nitrogen arrives in the exchanger via a feed tank (not illustrated) and the distribution corrugated fins 20, then flows downward along the passages 18. As it does so, it progressively gives up heat to the liquid oxygen that is in the adjacent passages 17, so that the oxygen vaporizes and the nitrogen condenses.

Figure 2:
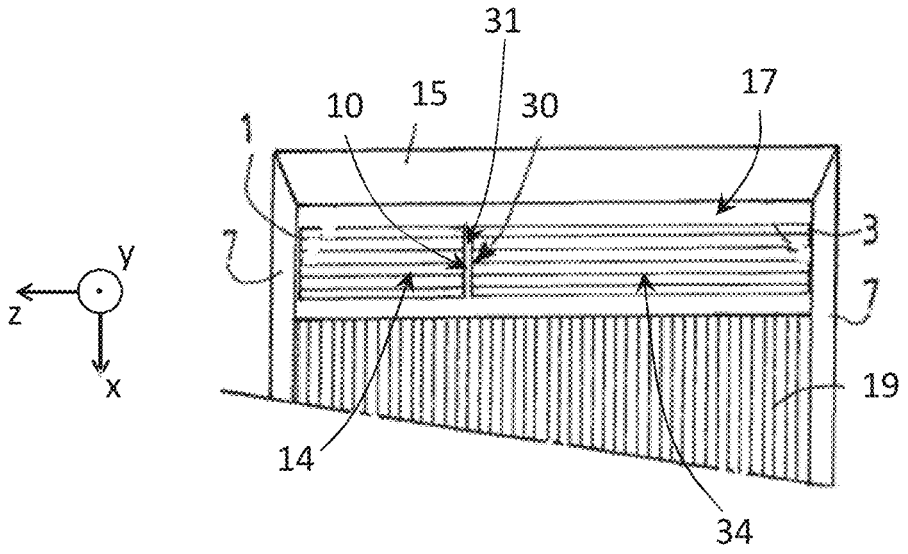
FIG. 2 is a schematic view in cross section of the exchanger of FIG. 1, FIG. 3 schematically depicts a corrugated fin of an exchanger according to one embodiment of the invention.

FIG. 2 schematically indicates a passage 17 for the flow of liquid oxygen. The passage 17 is formed between two parallel vertical plates (not depicted) separated by bars 15, 7 which plug the passages.

It is difficult to manufacture corrugated fins that are wide enough to cover the entire width of a passage of the heat exchanger. As can be seen in FIG. 2, use is therefore made of at least one first corrugated fin 14 and one second corrugated fin 34 which are juxtaposed in such a way as to form a strip of corrugated fin 24 as depicted in FIG. 1.

More specifically, the first and second corrugated fins 14, 34 extend between two successive plates (not illustrated in FIG. 2) so as to define, within the passage 17, a plurality of channels 14, 34. The first and second corrugated fins 14, 34 comprise two adjacent edges 10, 30, between them defining a zero or very small clearance 31, typically a clearance of the order of 0.1 to 5 mm at most.

In operation, the liquid oxygen passes through holes (not depicted in FIG. 2) positioned above the first and second corrugated fins 14, 34, at a flow rate that is defined by the bore section of these holes and by the height (liquid head) of the bath of liquid above them. The holes thus perform a primary distribution of the liquid oxygen across the entire width of the passage 17, and the liquid oxygen thus predistributed flows along the corrugated fins 14, 34, where each perform a fine secondary distribution thereof across the entire width of the passage 17. The liquid oxygen thus tackles a lower corrugated fin with a vertical generatrix 19 by trickling as uniformly as possible along all the walls of the passage assigned to it, namely by forming on these walls a continuous falling film.

It will therefore be appreciated that it is important for the two edges 10, 30 of the corrugated fins 14, 34 to be in as perfect contact as possible in order to avoid leaks of liquid and therefore to reduce the risk of the corrugated fins 14, 34 moving with respect to one another during the brazing of the exchanger.

In order to do this, the exchanger according to the invention comprises an assembly member 13 extending on each side of the edges 10, 30 so as to assemble said corrugated fins 1, 3 with one another. According to the invention, the assembly member 13 is forcibly engaged, on the one hand, in at least part of a channel 14 of the first corrugated fin 1 and, on the other hand, in at least part of a channel 34 of the second corrugated fin 3.

In other words, the member 13 is forcibly engaged or pushed, on the one hand, into at least part of a channel 14 of the first corrugated fin 1 and, on the other hand, into at least part of a channel 34 of the second corrugated fin 3.

In fact, the assembly member 13 is engaged under stress in the channels of the corrugated fins. For example, it might be possible to make the member 13 enter in the channels 14, 34 using a small tool, such as a flat-bladed screwdriver, that allows the assembly member to be forcibly engaged in the bottom of the corrugated fin and by applying manual pressure. The connection between the member 13 and the corrugated fins 14, 34 is achieved by elastic deformation of one and/or the other of these elements.

In this way, the assembly member 13 is blocked in position inside the channels 14, 34 by a wedging effect, which causes the first and second corrugated fins 1, 3 to be immobilized relative to one another. The forcible blocking of the assembly member 13 in the first and second corrugated fins 1, 3 secures the assembly member 13 to the first and second corrugated fins 1, 3 firmly than by simple insetting alone, and therefore ensures more robust joining-together of the corrugated fins 1, 3. The corrugated fins 1, 3 are thus assembled with one another by the member 13. The risk of a clearance appearing between the corrugated fins during the assembly of the exchanger is therefore greatly limited, or even eliminated.

The corrugated fins 1, 3 can thus be assembled with one another simply and quickly. Assembly requires no additional fixing means and can easily be implemented on an industrial scale, with a low investment cost.

For preference, the edges 10, 30 of the first and second corrugated fins 1, 3 are positioned in contact or in near-contact with one another so that there is no or practically no clearance between said corrugated fins 1, 3.

Advantageously, the two corrugated fins 1, 3 have the same configuration in terms of shape, dimensions and direction of corrugation and are arranged in such a way that their edges meet perfectly.

The exchanger may comprise several assembly members 13 arranged along the edges 10, 30. The number of assembly members 13 arranged along the edges 10, 30 may be adapted according to the length of said edges. For example, for corrugated fins of a length comprised between 30 and 100 mm, the exchanger may comprise two assembly members 13, as illustrated in FIG. 3.

Figure 3:
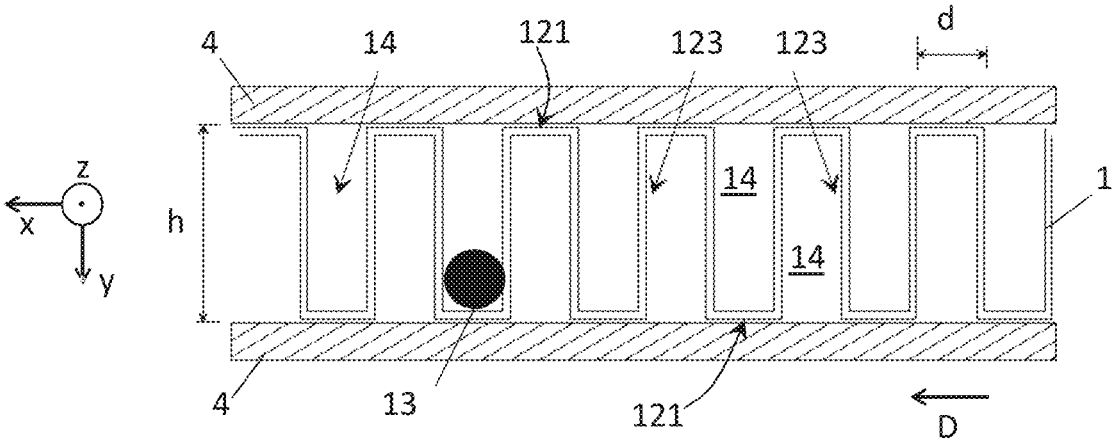

FIGS. 3 and 4 schematically indicate embodiments of the invention in which the channels 14, 34 and the assembly member 13 extend roughly parallel to a first direction z.

For preference, the length of the portions of the member 13 that are engaged, on the one hand, in the first corrugated fin 1 and, on the other hand, in the second corrugated fin 3, and measured in the first direction z, is greater than or equal to 5 mm, so as to ensure a sufficient connection with the corrugated fins 1, 3. By way of example, it is possible to use a member 13 with a total length of the order of 40 mm, portions with a length of approximately 20 mm each being engaged in the first corrugated fin 1 and the second corrugated fin 3 respectively.

Advantageously, the assembly member 13 has, in at least a second direction x orthogonal to said first direction z and prior to forcible engagement, an external dimension that is greater than or equal to the internal dimension of the channels 14, 34 in said second direction x.

Note that in the context of the invention, the dimensions or cross sections of the assembly member 13 mean values measured before it is assembled by being engaged in the channels of the corrugated fins, namely prior to any deformation that the member 13 may undergo.

For preference, the assembly member 13 will be overdimensioned and with respect to one or more internal transverse dimensions of the channels of the corrugated fins, so as to make the assembly more robust.

Thus, the ratio between the internal dimension of the channel 14 of the first corrugated fin 1 and said external dimension of the assembly member 13 and the ratio between the internal dimension of the channel 34 of the second corrugated fin 3 and said external dimension of the assembly member 13 are preferably comprised between 100 and 70%, more preferably comprised between 95 and 85%. Such values make it possible to achieve assembly without heavy tooling because the force of engagement can be provided by hand.

Advantageously, the forcible engagement is achieved by a fit referred to as an interference fit. In other words, the "fit" values, defined as being the differences between the external dimension or dimensions of the member 13 and the internal dimension or dimensions of the channels in the same directions are relatively high, preferably comprised between 0.1 and 0.5 mm.

For preference, said at least one external dimension of the assembly member 13 is comprised between 0.5 and 2 mm, preferably comprised between 1 and 1.3 mm. Such external dimensions are advantageous because the assembly member 13 then occupies only part of the height of the channels 14, 34 which, for conventional corrugated fins, is generally greater than 2 mm, typically comprised between 3 and 8 mm. Said height corresponding, with reference to FIG. 3, to the internal dimension of the channel 14 measured in a third direction y orthogonal to the first direction z and to the second direction x. Note that the external dimension of the assembly member 13 will advantageously be adapted according to the height of the corrugated fin.

For preference, the heights are chosen so that the first and second corrugated fins 1, 3 extend across almost all, or even all, of the width of the passage 17 in the third direction y.

According to one advantageous embodiment, illustrated notably in FIG. 3, the first and second corrugated fins 1, 3 each comprise a succession of corrugation legs 123, connected by corrugation vertices 121, the corrugation legs 123 following on from one another in a direction D referred to as the direction of corrugation. The assembly member 13 being forcibly engaged, on the one hand, between at least portions of two successive corrugation legs of the first corrugated fin and, on the other hand, between at least portions of two successive corrugation legs of the second corrugated fin. For the sake of clarity, only the first corrugated fin 1 is illustrated.

Each channel 14, 34 is defined between a plate 4, two successive corrugation legs 123, and the corrugation vertex 121 of the first or of the second corrugated fin 1, 3 connecting the two corrugation legs. Each channel 14 therefore forms a free passage within the passage 14, the member 13 being engaged, before the corrugated fins are fitted between the plates 4, between two successive corrugation legs 123.

The first and second corrugated fins 1, 3 are chosen from plain-fin, perforated-fin, serrated-fin, wavy-fin or herringbone-fin corrugated fins. The first and second corrugated fins 1, 3 preferably have substantially the same corrugation direction, shape and size. For preference, the first and second corrugated fins are each formed of a sheet or strip of corrugated aluminum.

The assembly member 13 may, in a plane perpendicular to the first direction z, have a cross section of circular, square, rectangular, octagonal or triangular shape.

For preference, the ratio between the cross section of the assembly member 13 and the cross section of the channel 14 of the first corrugated fin 1 and/or the ratio between the cross section of the assembly member 13 and the cross section of the channel 34 of the second corrugated fin 3 is less than or equal to 50%, preferably comprised between 15 and 35%. This then limits the reduction in bore section for the flow of the fluid through the corrugated fin 1 and the assembly member 13 does not disturb the distribution of the fluid.

Advantageously, the assembly member 13 is a solid component. For preference, the member 13 is a solid or tubular component of cylindrical shape.

According to one particular embodiment, the member 13 takes the form of a solid cylindrical rod. It might for example be possible to use a welding rod as an assembly member 13. Such components are commercially available and various materials or diameters are available. Several pieces of the desired length may even be cut from one rod.

FIG. 3 is a view in cross section of a plain first corrugated fin 1 having corrugation legs 123 with a planar surface. According to this exemplary embodiment, the channels 14 have a cross section of rectangular overall shape. A member 13 of circular cross section is forcibly engaged between two successive corrugation legs 123. The edges (10, 30) extend parallel to the second direction x. The second corrugated fin 3 (not illustrated), arranged edge to edge with the first corrugated fin 1 has a similar corrugation shape and size.

In the example given in FIG. 3, the dimension of the assembly member 13 is determined with respect to the width of the channels 14, 34 corresponding to the internal dimension d measured in the second direction x.

Advantageously, the member 13 is such that the ratio between the internal dimension d and the external diameter of the member 13 is comprised between 100 and 70%, preferably comprised between 95 and 85%. Such values make it possible to achieve assembly without heavy tooling because the force can be provided by hand.

The assembly member 13 has a given outside diameter, typically comprised between 0.5 and 2 mm, preferably comprised between 1 and 1.3 mm. In that way, the assembly member 13 occupies only part of the height of the channel 14 which, in the case of conventional corrugated fins, is generally greater than 2 mm, typically comprised between 3 and 8 mm.

The features listed above in the case of the first corrugated fin 1 of course also apply to the second corrugated fin 3.

Orifices may potentially be pierced through the assembly member 13 and/or said member 13 may have a slotted peripheral wall. In this way, additional empty spaces are created within the channels 14, 34 thereby avoiding reducing the bore section for the flow of fluid and further limiting the disruption to the distribution of the fluid.

For preference, the assembly member 13 is formed of a material that has a melting point higher than or equal to that of the materials of the first and second corrugated fins 1, 3. This then avoids the assembly member 13 melting during the brazing of the exchanger.

For preference, the first and second corrugated fins 1, 3 and the assembly member 13 are formed from the same material, notably so as not to give rise to differences in expansion of the member 13 with respect to the corrugated fins 1 and 3 during the operation of the exchanger, particularly as it is cooling, and as it is warming up to ambient temperature during an ASU shutdown for example. Such differences in expansion may also arise as a result of temperature variations during brazing.

The first and second corrugated fins 1, 3 and the assembly member 13 are advantageously made of a metallic material. This material may be selected from stainless steel, aluminum or an aluminum alloy.

Figure 4A:
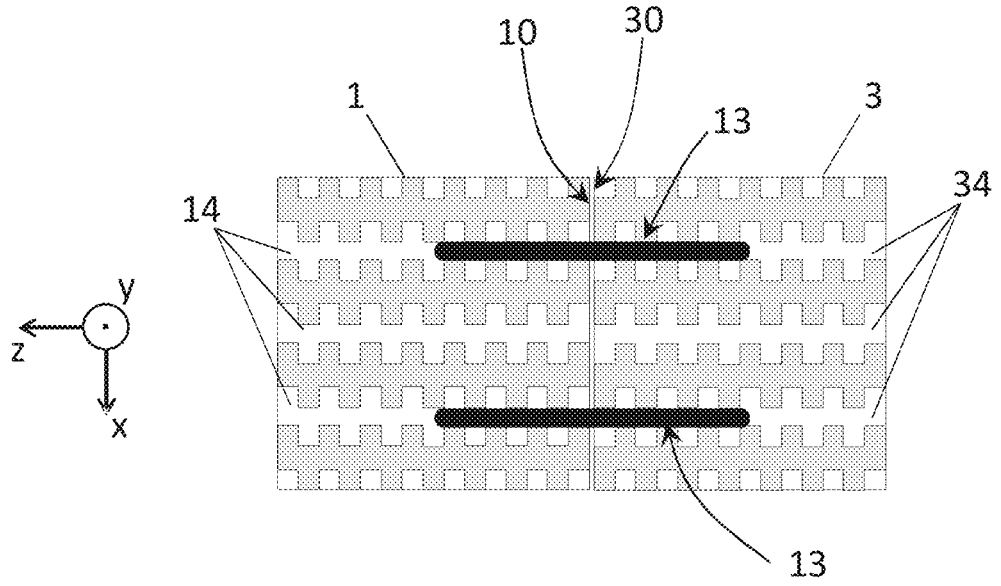
FIGS. 4A, 4B are schematic views, on two mutually-perpendicular respective planes of section, of two corrugated fins of an exchanger according to another embodiment of the invention.
Figure 4B:
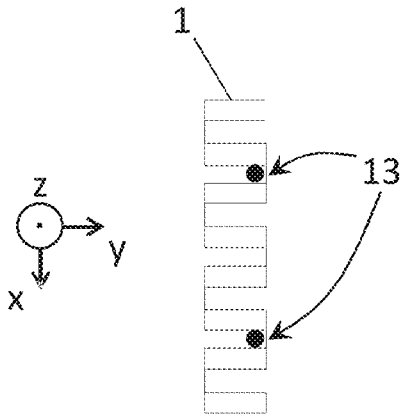
Figure 5:
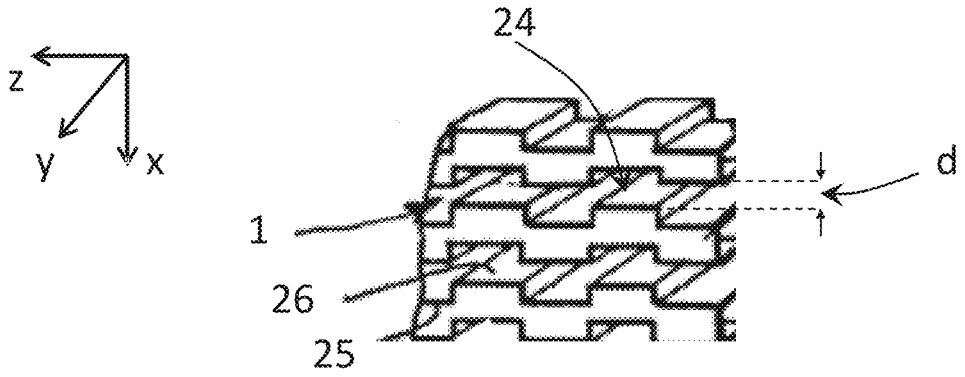
FIG. 5 is a three-dimensional view of one of the corrugated fins of FIGS. 4A, and 4B.

FIGS. 4A, 4B and 5 illustrate an alternative form of embodiment in which the corrugated fins 1, 3 are of the serrated fin type. More specifically, and as visible in FIG. 5, each horizontal or near-horizontal facet 25 of the corrugated fins 1, 3 is provided, at regular intervals, with a recess 26 which is offset upward by one quarter of a corrugation pitch. The width of the recesses, measured along the generatrrix of the corrugated fin, is of the same order of magnitude as the distance separating each of them from the two adjacent recesses situated on the same facet.

In this alternative form, the width of the channels 14, 34, measured in the second direction x, varies in the first direction z according to the way in which the recesses 26 are positioned. The assembly member 13 is preferably dimensioned with respect to the minimum width of the channels 14, 34 which corresponds to the internal dimension d as depicted in FIG. 5.

The width of the channels 14, 34 corresponds to the internal dimension d measured in the second direction x, the external dimensions of the assembly member 13 being defined in such a way that it can be forcibly engaged in said channels 14, 34.

Advantageously, the plurality of passages which is defined between the plates 4 of the exchanger comprises a first set of passages 17 which are intended for the flow of a refrigerant fluid, and a second set of passages 18 for the flow of a thermogenic fluid.

The invention is particularly advantageous in the case of a refrigerant fluid in the liquid state. The assembly member 13 is preferably arranged between the first and second corrugated fins 1, 3 of at least one passage 17 of the first set.

For preference, the first and second corrugated fins 1, 3 arranged in the passages 17, 18 have horizontal generatrices, namely are arranged in the "hardway" configuration.

Advantageously, the first and second corrugated fins 1, 3 are extended, downstream in the direction in which the fluid flows in the passage concerned, by heat-exchange corrugated fins 19. These heat-exchange corrugated fins 19 are preferably of the type having a vertical generatrix, namely arranged in the so-called "easyway" configuration.

For preference, the second direction x is vertical when the exchanger 2 is in operation. The refrigerant and thermogenic fluids flow vertically and concurrentwise overall, in the downflow direction.

Of course, the invention is not restricted to the particular examples described and illustrated in the present application. Other alternative forms or embodiments within the competence of those skilled in the art may also be considered without departing from the scope of the invention defined in the claims which follow.

Thus, other directions and senses for the flow of the fluids are conceivable, without departing from the scope of the present invention. For example, it would be possible to envisage the fluids circulating countercurrentwise through the exchanger 2. One or more refrigerant fluids and one or more thermogenic fluids of different kinds may also flow within the passages 17, 18 of the one same exchanger.

It is also conceivable for the corrugated fins of the exchanger to have corrugation directions, dimensions and/or shapes different from those of the embodiments described above.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A heat exchanger for vaporizing a refrigerant fluid by exchange of heat with a thermogenic fluid, said exchanger comprising:

a. a plurality of parallel plates between them defining a plurality of passages designed for the flow of the refrigerant fluid or of the thermogenic fluid, wherein the plurality of parallel plates extend parallel to a second direction (x);

b. a first corrugated fin and a second corrugated fin extending between two successive parallel plates in such a way as to define, within the one same passage, a plurality of channels extending generally parallel to a first direction (z) that is orthogonal to the second direction (x), said first and second corrugated fins comprising two adjacent edges that extend parallel to the second direction (x);

c. at least one assembly member extending on each side of the adjacent edges so as to join said corrugated fins together;

wherein the assembly member is forcibly engaged, on end, in at least part of a channel of the first corrugated fin and, on another end, in at least part of a channel of the second corrugated fin, wherein the channels and the assembly member extend roughly parallel to the first direction, said assembly member having, in at least the second direction (x) orthogonal to said first direction and prior to engagement, an external dimension that is greater than or equal to the internal dimensions of the channels in said second direction (z), wherein the first and second corrugated fins are formed from a first material and the assembly member is formed from a second material, the second material having a melting point higher than or equal to the melting point of the first material.

2. The exchanger as claimed in claim 1, further comprising several assembly members arranged along the adjacent edges.

3. The exchanger as claimed in claim 1, wherein the ratio between the internal dimension of the channel of the first corrugated fin and said external dimension of the assembly member and the ratio between the internal dimension of the channel of the second corrugated fin and said external dimension of the assembly member are comprised between 100 and 70%.

4. The exchanger as claimed in claim 1, wherein the ratio between the cross section of the assembly member and the cross section of the channel of the first corrugated fin and/or the ratio between the cross section of the assembly member and the cross section of the channel of the second corrugated fin being less than or equal to 50%, said cross sections being measured in a plane perpendicular to the first direction (z).

5. The exchanger as claimed in claim 1, wherein said second direction (x) extends parallel to the edges.

6. The exchanger as claimed in claim 5, wherein the assembly member is of cylindrical shape and has a given outside diameter, the ratios between the widths of the channels, measured in the second direction (x), and said outside diameter being comprised between 100 and 70%.

7. The exchanger as claimed in claim 1, wherein the assembly member comprises a first portion forcibly engaged in at least part of one channel and a second portion forcibly engaged in at least part of a channel of the second corrugated fin, said first and second portions having lengths, measured parallel to the first direction (z), greater than or equal to 5 mm.

8. The exchanger as claimed in claim 1, wherein the assembly member comprises a holed or slotted peripheral wall.

9. The exchanger as claimed in claim 1, wherein the plates extend parallel to a direction referred to as the flow direction, the channels and the assembly member extend overall in a first direction orthogonal to the flow direction.

10. The exchanger as claimed in claim 1, wherein the first and second corrugated fins each comprise a succession of corrugation legs connected by corrugation vertices, the assembly member being forcibly engaged, on the one hand, between at least portions of two successive corrugation legs of the first corrugated fin and, on the other hand, between at least portions of two successive corrugation legs of the second corrugated fin.

11. The exchanger as claimed in claim 10, wherein each channel is defined between a plate, two successive corrugation legs of the first or of the second corrugated fin and a corrugation vertex connecting said two corrugation legs.

12. The exchanger as claimed in claim 1, wherein the first and second corrugated fins are selected from the group consisting of plain-fin, perforated-fin, serrated, wavy-fin, and herringbone-fin corrugations.

13. An air separation installation separating air by distillation, wherein the air separation installation comprises at least one heat exchanger as claimed in claim 1, and in that the air separation installation comprises feed means configured to distribute liquid oxygen by way of refrigerant fluid, and gaseous nitrogen by way of thermogenic fluid, into the passages of the heat exchanger.

14. A heat exchanger for vaporizing a refrigerant fluid by exchange of heat with a thermogenic fluid, said exchanger comprising;

a. a plurality of parallel plates between them defining a plurality of passages designed for the flow of the refrigerant fluid or of the thermogenic fluid, wherein the plurality of parallel plates extend parallel to a second direction (x);

b. a first corrugated fin and a second corrugated fin extending between two successive parallel plates in such a way as to define, within the one same passage, a plurality of channels extending generally parallel to a first direction (z) that is orthogonal to the second direction (x), said first and second corrugated fins comprising two adjacent edges that extend parallel to the second direction (x);

c. at least one assembly member extending on each side of the adjacent edges so as to join said corrugated fins together;

wherein the assembly member is forcibly engaged, on end, in at least part of a channel of the first corrugated fin and, on another end, in at least part of a channel of the second corrugated fin, wherein the channels and the assembly number extend roughly parallel to the first direction, said assembly member having, in at least the second direction (x) orthogonal to said first direction and prior to engagement, an external dimension that is greater than or equal to the internal dimensions of the channels in said second direction (z), wherein said second direction (x) extends parallel to the edges, wherein the assembly member is of cylindrical shape and has a given outside diameter, the ratios between the widths of the channels, measured in the second direction (x), and said outside diameter being comprised between 100 and 70%, wherein the outside diameter of the assembly member is comprised between 0.5 and 2 mm.

15. The exchanger as claimed in claim 14, wherein the first and second corrugated fins are formed from a first material and the assembly member is formed from a second material, the second material having a melting point higher than or equal to the melting point of the first material.

* * * * *